US009166311B2

(12) United States Patent
Hu et al.

(10) Patent No.: US 9,166,311 B2
(45) Date of Patent: Oct. 20, 2015

(54) FIXING BRACKET FOR FIXING A SIGNAL CONNECTOR TO A PRINTED CIRCUIT BOARD

(71) Applicant: ASKEY COMPUTER CORP., New Taipei (TW)

(72) Inventors: Chen-Chou Hu, Taoyuan County (TW); Tzu-Huang Huang, Taoyuan County (TW)

(73) Assignee: ASKEY COMPUTER CORP., New Taipei (TW)

( * ) Notice: Subject to any disclaimer, the term of this patent is extended or adjusted under 35 U.S.C. 154(b) by 2 days.

(21) Appl. No.: 14/294,121

(22) Filed: Jun. 2, 2014

(65) Prior Publication Data

US 2015/0044904 A1 Feb. 12, 2015

(30) Foreign Application Priority Data

Aug. 12, 2013 (TW) ..... 102128852 A

(51) Int. Cl.
*H01R 13/627* (2006.01)
*H01R 12/70* (2011.01)

(52) U.S. Cl.
CPC ..... *H01R 12/7023* (2013.01); *H01R 13/627* (2013.01)

(58) Field of Classification Search
USPC ..... 439/351–358, 384, 541.5
See application file for complete search history.

(56) References Cited

U.S. PATENT DOCUMENTS

| | | | | |
|---|---|---|---|---|
| 6,126,325 | A * | 10/2000 | Yamane et al. | 385/92 |
| 6,461,054 | B1 * | 10/2002 | Iwase | 385/73 |
| 6,634,796 | B2 * | 10/2003 | de Jong et al. | 385/56 |
| 6,716,060 | B2 * | 4/2004 | Gollhofer et al. | 439/567 |
| 7,059,779 | B2 * | 6/2006 | Khor | 385/65 |
| 7,226,297 | B2 * | 6/2007 | Li | 439/71 |
| 7,918,671 | B2 * | 4/2011 | Chen et al. | 439/70 |
| 8,215,995 | B1 * | 7/2012 | Little et al. | 439/638 |
| 8,241,046 | B2 * | 8/2012 | Takagi et al. | 439/83 |
| 8,894,444 | B2 * | 11/2014 | Funahashi | 439/620.03 |
| 2005/0153600 | A1 * | 7/2005 | Lu | 439/607 |
| 2007/0093110 | A1 * | 4/2007 | Park et al. | 439/351 |

* cited by examiner

*Primary Examiner* — Chandrika Prasad
(74) *Attorney, Agent, or Firm* — Jianq Chyun IP Office

(57) ABSTRACT

A fixing bracket for signal connector adapted to fix a signal connector to a circuit board is provided. The fixing bracket includes a base, a fixing member protruding from a bottom surface of the base and at least two engaging sets protruding from a top surface of the base. The fixing member is adapted to pass through and interfere with the circuit board. Each engaging set includes a first restricting surface and a second restricting surface which are adjacent to each other and perpendicular to the top surface, and a third restricting surface parallel to the top surface. The two first restricting surfaces, the two second restricting surfaces and the two third restricting surfaces of the two engaging sets are used for respectively contacting two first surfaces, two second surfaces and two third surfaces of the signal connector so as to fix the signal connector.

10 Claims, 12 Drawing Sheets

FIXING BRACKET FOR FIXING A SIGNAL CONNECTOR TO A PRINTED CIRCUIT BOARD

CROSS-REFERENCE TO RELATED APPLICATION

This application claims the priority benefit of Taiwan application serial no. 102128852, filed on Aug. 12, 2013. The entirety of the above-mentioned patent application is hereby incorporated by reference herein and made a part of this specification.

FIELD OF THE DISCLOSURE

The disclosure generally relates to a fixing bracket. More particularly, the disclosure relates to a fixing bracket for signal connector.

DESCRIPTION OF RELATED ART

With the continuous advancement and improvement of electronic technology and communication techniques, various signal connectors may used for transmitting signals between electronic devices. FIG. 1 is a schematic view illustrating a signal connector. Referring to FIG. 1, the signal connector 10 shown in FIG. 1 is an optical fiber signal connector for transmitting optical signals, wherein the signal connector 10 includes a body 12 and two protruding portions 14 symmetrically protruding from the body 12. Each of the two protruding portions 14 has two opposite first surfaces S1, the body 12 has two opposite second surfaces S2 and two opposite third surfaces S3, as shown in FIG. 1, each of the first surfaces S1, each of the second surfaces S2, and each of the third surfaces S3 are perpendicular to one another. This kind of signal connector 10 is disposed on the circuit board of a router generally, so that an optical fiber terminal (e.g., SC/APC) may insert therein. Since the signal connector 10 does not need to be electrically connected with the circuit board, it may be fixed onto the circuit board generally as illustrated in the following methods.

FIG. 2A is a schematic view illustrating a fixing manner that the signal connector of FIG. 1 is fixed on the circuit board. Referring to FIG. 2A, one of the fixing manners that the signal connector 10 is fixed on the circuit board 20 is: a metal element 30 is fixed on the signal connector 10, the metal element 30 extends from the bottom to the two sides of the signal connector 10, and the metal element 30 is fastened to the circuit board 20 through the screws 32, as such the signal connector 10 is fixed on the circuit board 20.

FIG. 2B is a schematic view illustrating another fixing manner that the signal connector of FIG. 1 is fixed on the circuit board. FIG. 2C is the top view of FIG. 2B. Referring to FIG. 2B and FIG. 2C, another fixing manner that the signal connector 10 is fixed on the circuit board 20 is: the metal elastic element 40 is fixed on two sides of the signal connector 10 and the plastic frame 42 is fixed on the circuit board 20. The plastic frame 42 has two protruding blocks 44 and two stopping walls 46 which are integrally formed, a passage for the signal connector 10 to slide therein is formed between the two protruding blocks 44, the two stopping walls 46 are respectively located at a side of the two protruding blocks 44 and the distance between the two stopping walls 46 is slightly larger than the distance between the two protruding blocks 44. When the signal connector 10 slides along the arrow direction shown in FIG. 2B, the two metal elastic elements 40 located two sides of the signal connector 10 are respectively compressed by the two protruding blocks 44, such that the signal connector 10 may pass through the passage formed between the two protruding blocks 44, until the protruding portions 14 of the signal connector 10 are blocked by the protruding blocks 44 and cannot continue to move along the arrow direction. At this moment, the metal elastic element 40 is not compressed by the two protruding blocks 44, and the metal elastic element 40 may recover and slightly extends toward two sides, as shown in FIG. 2C, props against the stopping walls 46 and the protruding blocks 44, so that the signal connector 10 is fixed on the circuit board 20.

FIG. 2D is a schematic view illustrating another fixing manner that the signal connector of FIG. 1 is fixed on the circuit board. Referring to FIG. 2D, another fixing manner that a signal connector 10 is fixed on the circuit board 20 is: a U-shaped metal element 50 clips and fixes on two sides of the signal connector 10, and a portion of the metal element 50 located at the bottom of the signal connector 10 is welded to the circuit board 20, as such the signal connector 10 is fixed on the circuit board 20.

All of the fixing manners of fixing the signal connector to the circuit board illustrated above need a metal element or metal elastic element, and this not only increases the manufacturing cost but also increases complexity in assembling.

SUMMARY OF THE DISCLOSURE

The disclosure provides a fixing bracket for signal connector, wherein the fixing bracket is adapted for a signal connector may rapidly and simply be fixed to a circuit board, and has a lower manufacturing cost.

The disclosure provides a fixing bracket for signal connector adapted for fixing a signal connector onto a circuit board. The circuit board includes an assembling hole, and the signal connector includes a body and two protruding portions symmetrically protruding from the body. Each of the protruding portions has two opposite first surfaces, the body has two opposite second surfaces and two opposite third surfaces, each of the first surfaces, each of the second surfaces and each of the third surfaces are perpendicular to one another. The fixing bracket for signal connector includes a base, at least one fixing member and two engaging sets. The base includes a top surface and a bottom surface opposite to each other. The fixing member protrudes from the bottom surface of the base, wherein each of the fixing members is adapted to pass through the assembling hole from a surface of the circuit board and interfere with another surface of the circuit board. The two engaging sets protrudes from the top surface of the base, and each of the two engaging sets includes at least one first restricting surface perpendicular to the top surface, at least one second restricting surface perpendicular to the top surface, and a third restricting surface parallel to the top surface, and the first restricting surface is adjacent to the second restricting surface. The two at least one first restricting surfaces of the two engaging sets are adapted to respectively at least contact one of the two first surfaces of each of the two protruding portions of the signal connector, and the two first surfaces which contact the two at least one first restricting surfaces of the two engaging sets are not coplanar. The two at least one second restricting surfaces of the two engaging sets are adapted to respectively contact the two second surfaces of the signal connector. And the two third restricting surfaces of the two engaging sets and the top surface are adapted to respectively contact the two third surfaces of the signal connector, so as to fix the signal connector.

In one exemplary embodiment of the disclosure, each of the two engaging sets is a hook-shaped flexible arm, and the two engaging sets are staggered, such that projections of the two second restricting surfaces projecting onto a surface on which any one of the two second restricting surfaces exists are not overlapped to each other.

In one exemplary embodiment of the disclosure, each of the two engaging sets includes two hook-shaped flexible arms, and the two engaging sets are disposed oppositely.

In one exemplary embodiment of the disclosure, each of the two engaging sets includes a hook-shaped flexible arm and an engaging slot located at a side of the hook-shaped flexible arm, the two hook-shaped flexible arms are staggered and the two engaging slots are disposed opposite to each other, each of the engaging slots extends away from the top surface, and the first restricting surface is one of innerwall surfaces of the engaging slot.

In one exemplary embodiment of the disclosure, each of the two engaging sets includes two hook-shaped flexible arms and an engaging slot, the engaging slot is located between the two hook-shaped flexible arms and extends away from the top surface, the first restricting surface is one of innerwall surfaces of the engaging slot, and the two engaging sets are disposed oppositely.

In one exemplary embodiment of the disclosure, the fixing bracket for signal connector further includes a positioning protruding block protruding from the bottom surface of the base, and the circuit board further includes a positioning hole corresponding to the positioning protruding block.

In one exemplary embodiment of the disclosure, each of the fixing member comprises an end portion which is away from the bottom surface and at least two flexible segment portions, the flexible segment portions are averagely disposed around the end portion and extend toward the bottom surface, a maximum outer diameter of the flexible segment portions is W mm, a diameter of the assembling hole is D mm, wherein $D\ mm \leq W\ mm \leq D+0.2\ mm$.

In one exemplary embodiment of the disclosure, a number of the fixing member is two, each of the fixing members includes two flexible segment portions, a connecting line of the two flexible segment portions of one of the two fixing members intersects a connecting line of the two flexible segment portions of the other of the two fixing members.

In one exemplary embodiment of the disclosure, a diameter of the assembling hole is D mm, and $3.3\ mm<D<3.7\ mm$.

In one exemplary embodiment of the disclosure, the signal connector is an optical fiber signal connector.

In light of the above, in the fixing bracket for signal connector of the disclosure, two engaging sets protruding from the top surface are used for fixing the signal connector, and the first, second and third restricting surfaces of the two engaging sets may contact the first, second and third surfaces of the signal connector, so that the signal connector may be restricted in different directions. In addition, in the fixing bracket for signal connector of the disclosure, through the fixing member protruding from the bottom surface, wherein the flexible segment portions of the fixing member may be flexibly deformed to pass through the assembling hole of the circuit board first and may recover after passing through, and since the maximum outer diameter of the flexible segment portions is larger than the diameter of the assembling hole when the flexible segment portions are not compressed, the flexible segment portions may stay on the other surface of the circuit board, such that the fixing bracket is rapidly assembled to the circuit board in one only step. The fixing bracket for signal connector of the disclosure may be easily fixed to the circuit board, and is also provided for the signal connector being fixed thereto. The assembling process is quite rapid and simple, and any metal element is not required. Thus, manufacturing cost may be effectively reduced.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
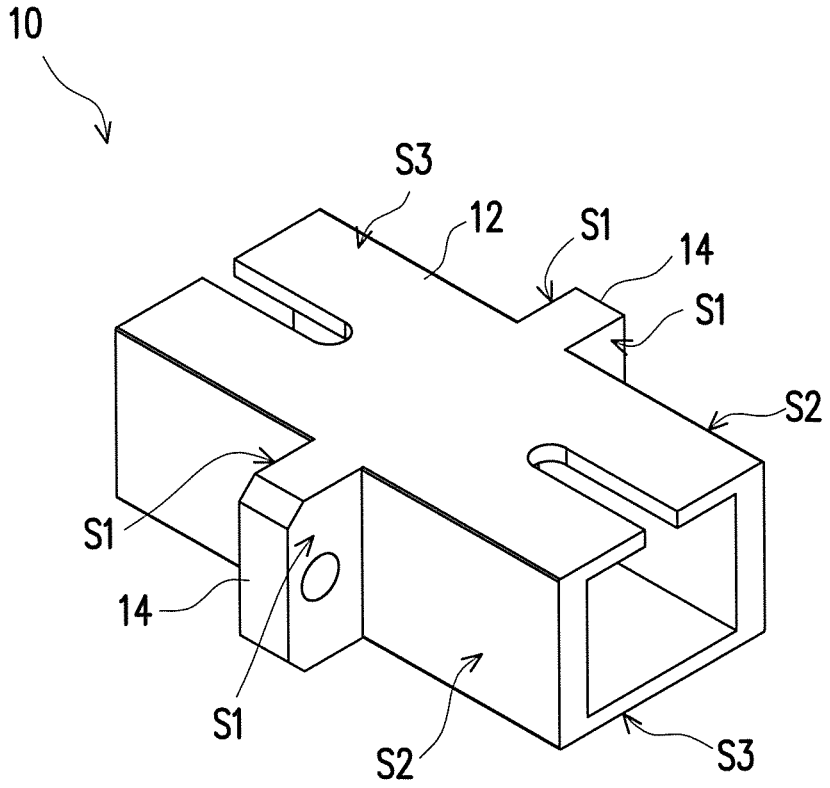
FIG. 1 (RELATED ART)
FIG. 1 is a schematic view illustrating a signal connector.
Figure 2A:
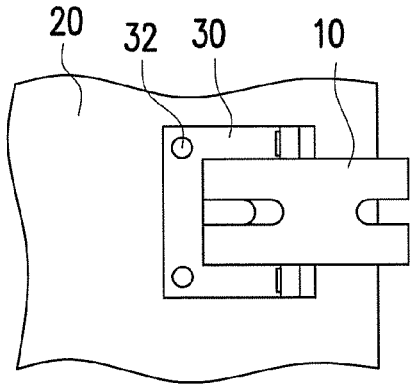
FIG. 2A(RELATED ART)
FIG. 2A is a schematic view illustrating a fixing manner that the signal connector of FIG. 1 is fixed on the circuit board.
Figure 2B:
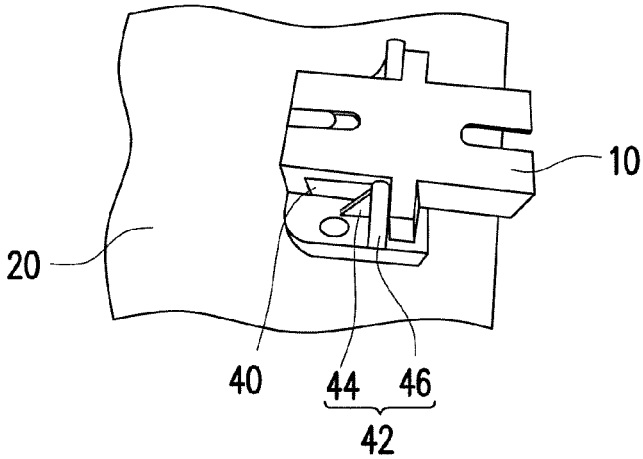
FIG. 2B(RELATED ART)
FIG. 2B is a schematic view illustrating another fixing manner that the signal connector of FIG. 1 is fixed on the circuit board.
Figure 2C:
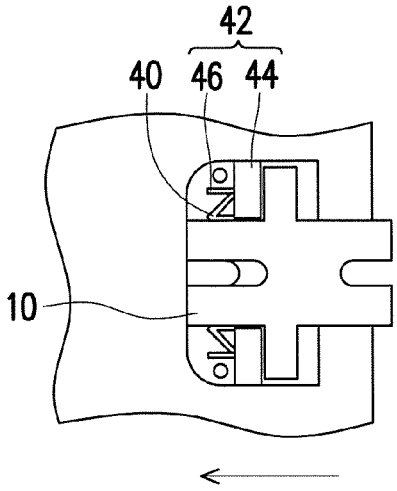
FIG. 2C(RELATED ART)
FIG. 2C is the top view of FIG. 2B.
Figure 2D:
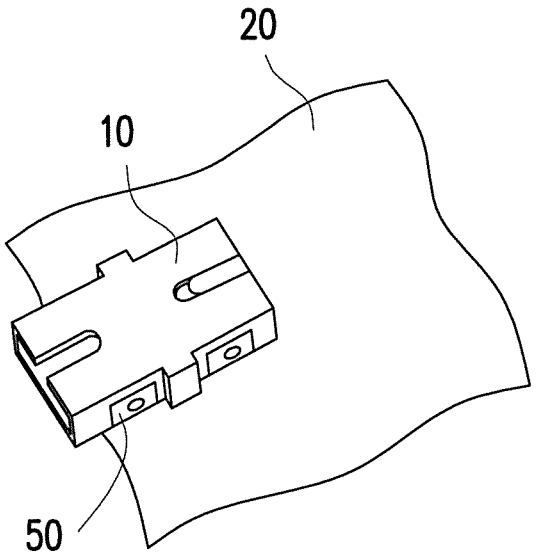
FIG. 2D(RELATED ART)
FIG. 2D is a schematic view illustrating another fixing manner that the signal connector of FIG. 1 is fixed on the circuit board.

The fixing bracket for signal connector of the disclosure is adapted for fixing a signal connector 10 which is shown in FIG. 1 onto a circuit board 20. The signal connector 10 is an optical fiber signal connector for example, but the type of the signal connector 10 is not limited in the disclosure, and any type of signal connector 10 which is not required to be electrically connected to the circuit board 20 may be fixed to the circuit board 20 through the fixing bracket for signal connector of the disclosure.

Figure 3A:
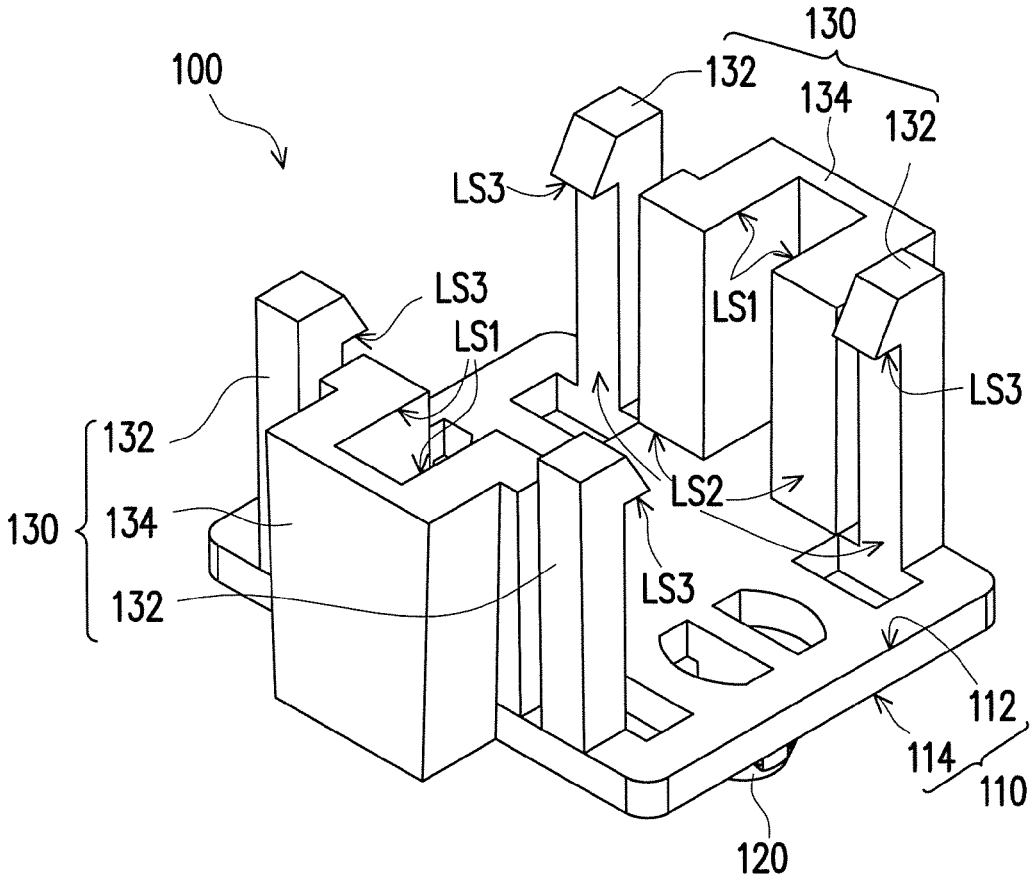
FIG. 3A is a schematic view illustrating a fixing bracket for signal connector according to an exemplary embodiment of the disclosure.

FIG. 3A is a schematic view illustrating a fixing bracket for signal connector according to an exemplary embodiment of the disclosure. Referring to FIG. 3A, a fixing bracket for signal connector 100 of the embodiment includes a base 110, at least one fixing member 120 and two engaging sets 130. In the embodiment, the material of the fixing bracket for signal connector 100 is plastic, and the base 110, the fixing member 120, the engaging sets 130 and the positioning protruding blocks 140 are integrally formed, but the material of the fixing bracket for signal connector 100 and the forming method of the base 110, the fixing member 120, the engaging sets 130 and the positioning protruding blocks 140 are not limited thereto.

The base 110 includes a top surface 112 and a bottom surface 114 opposite to each other. The two engaging sets 130 protrude from the top surface 112 of the base 110 and are oppositely disposed. Each of the engaging sets 130 includes two hook-shaped flexible arms 132 and an engaging slot 134, wherein the engaging slot 134 is located between the two hook-shaped flexible anus 132 and extends toward a direction away from the top surface 112.

Each engaging set 130 includes a first restricting surface LS1 and a second restricting surface LS2 which are perpendicular to the top surface 112 and adjacent to each other, and a third restricting surface LS3 which is parallel to the top surface 112. In the embodiment, each engaging slot 134 has two first restricting surfaces LS1 and two second restricting surfaces LS2, wherein the two first restricting surfaces LS1 are the two opposite innerwall surfaces of the engaging slot 134, and the two second restricting surfaces LS2 are respectively adjacent to the two first restricting surfaces LS1. Each hook-shaped flexible arm 132 has a second restricting surface LS2 and a third restricting surface LS3 which are adjacent to each other. In the embodiment, all of the engaging slots 134 and the hook-shaped flexible anus 132 have second restricting surfaces LS2, however in other embodiments it is not limited thereto, as long as at least one of each engaging slot 134 and each hook-shaped flexible arm 132 has the second restricting surface LS2.

When the signal connector 10 is assembled to the fixing bracket for signal connector 100, since the hook-shaped flexible arms 132*a* are flexible, and as long as the signal connector 10 is compressed into the fixing bracket for signal connector 100, the four hook-shaped flexible arms 132 may be slightly and flexibly deformed outward, such that the signal connector 10 may have a sufficient room to enter between the two engaging sets 130. Or, the user may also directly separate the hook-shaped flexible arms 132, such that the signal connector 10 enters between the two engaging sets 130.

Figure 3B:
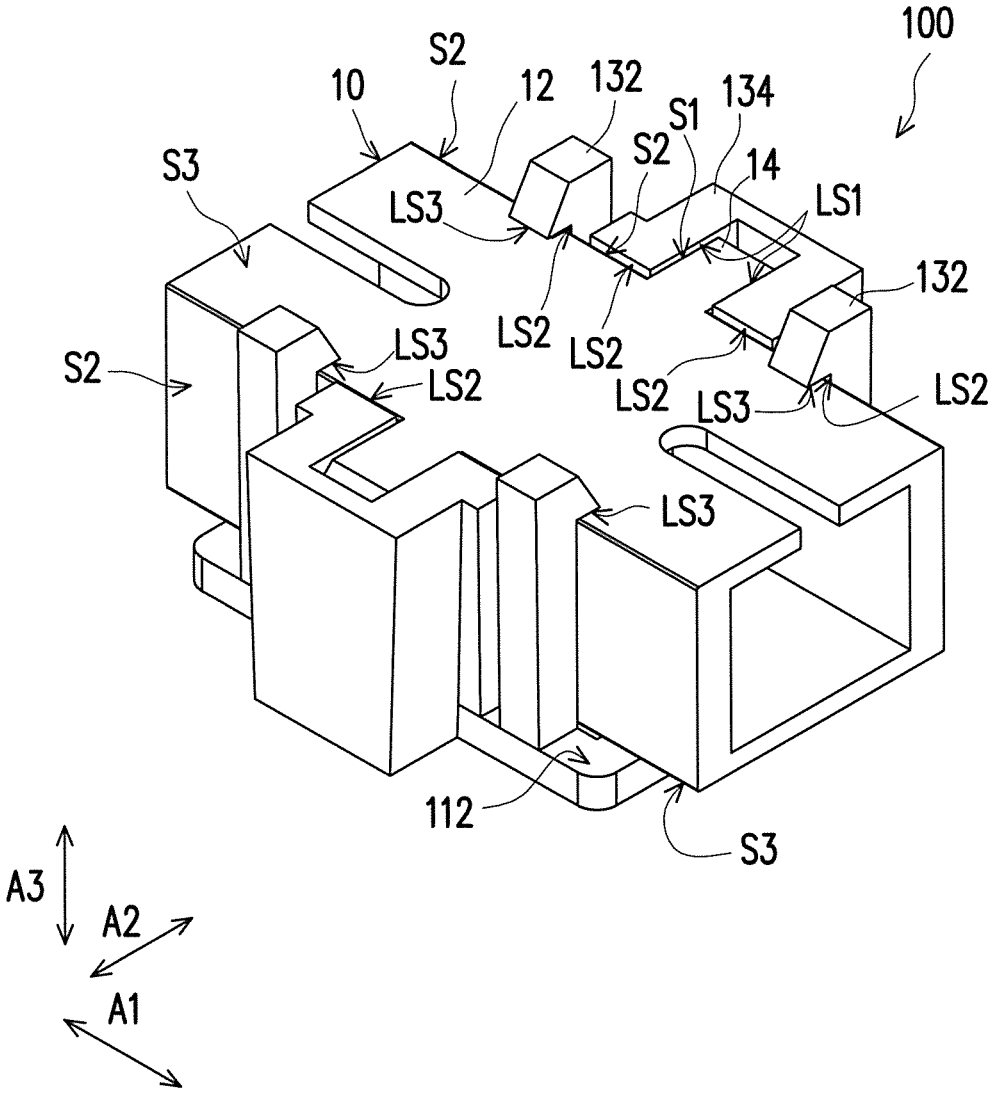
FIG. 3B is a schematic view illustrating the signal connector assembled to the fixing bracket for signal connector of FIG. 3A.

FIG. 3B is a schematic view illustrating the signal connector assembled to the fixing bracket for signal connector of FIG. 3A. As shown in FIG. 3B, when the signal connector 10 is located between the at least two engaging sets 130, the two protruding portions 14 are located within the two engaging slots 134. The two first restricting surfaces LS1 of each engaging slot 134 contact the two first surfaces S1 of the two protruding portions 14 respectively, in order that the signal connector 10 moving toward a first axis A1 is restricted. The engaging slots 134 and the two second restricting surfaces LS2 of each hook-shaped flexible arm 132 contact the two second surfaces S2 of the signal connector 10 respectively, in order that the signal connector 10 moving toward a second axis A2 is restricted. The third restricting surface LS3 of the hook-shaped flexible arm 132 and the top surface 112 of the base 110 contact the two top and bottom third surfaces S3 respectively, in order that the signal connector 10 moving toward a third axis A3 is restricted. According to the way mentioned above, the signal connector 10 may very rapidly and simply be fixed onto the fixing bracket for signal connector 100. In the embodiment, the first axis A1, the second axis A2 and the third axis A3 are perpendicular to one another.

Figure 3C:
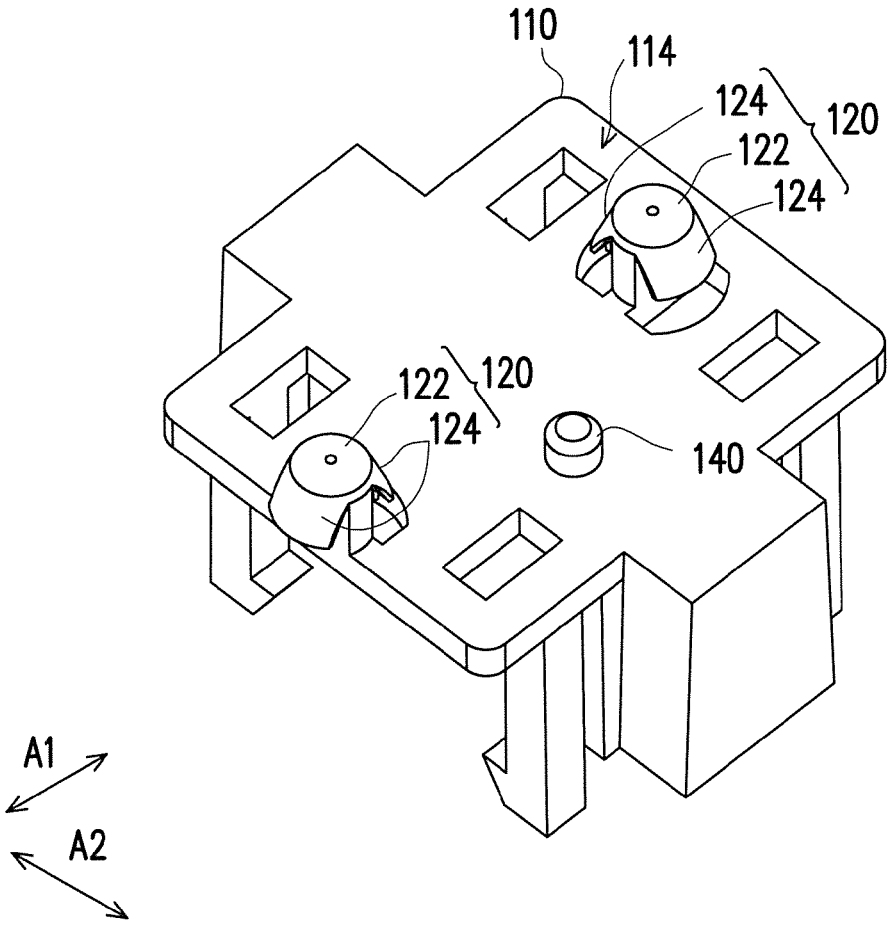
FIG. 3C is a schematic view of the fixing bracket for signal connector depicted in FIG. 3A from another viewing angle.

FIG. 3C is a schematic view of the fixing bracket for signal connector depicted in FIG. 3A from another viewing angle. Referring to FIG. 3C, in the embodiment, the number of the fixing member 120 is two, and the fixing bracket for signal connector 100 further includes a positioning protruding block 140. The two fixing members 120 and the positioning protruding block 140 respectively protrude from the bottom surface 114 of the base 110. Each fixing member 120 includes an end portion 122 which is away from the bottom surface 114 and two flexible segment portions 124, wherein the flexible segment portions 124 of the fixing member 120 are averagely disposed around the end portion 122 and extend toward the bottom surface 114.

Figure 3D:
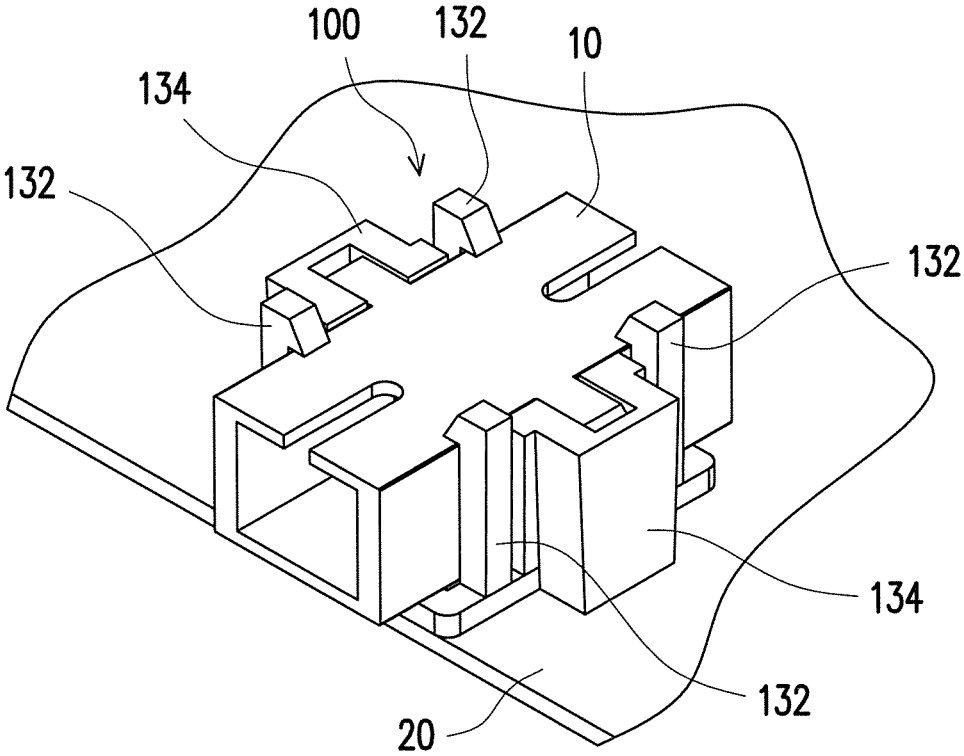
FIG. 3D is a schematic view illustrating the signal connector and the fixing bracket for signal connector depicted in FIG. 3B is fixed to the circuit board.
Figure 3E:
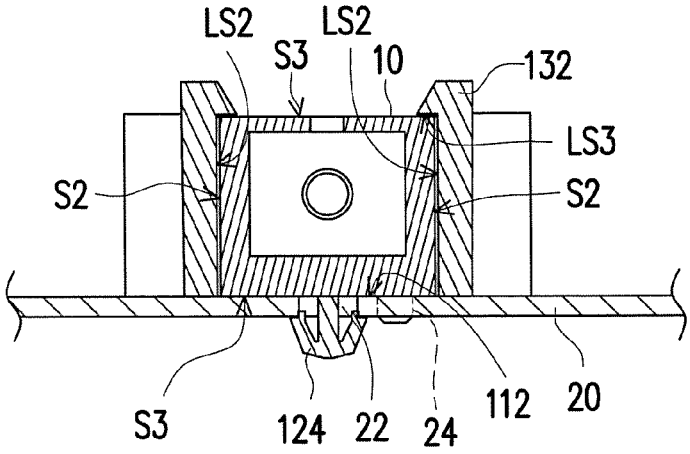
FIG. 3E is a schematic cross-sectional view of FIG. 3D.

FIG. 3D is a schematic view illustrating the signal connector and the fixing bracket for signal connector depicted in FIG. 3B is fixed to the circuit board. FIG. 3E is a schematic cross-sectional view of FIG. 3D. With reference to FIG. 3D and FIG. 3E, the circuit board 20 includes at least one assembling hole 22 and a positioning hole 24. In the embodiment, the number of the assembling holes 22 is two, the related positions of the assembling hole 22 and the positioning hole 24 on the circuit board 20 correspond to the related positions of the fixing member 120 and the positioning protruding block 140 on the bottom surface 114.

If the fixing bracket for signal connector 100 is going to be fixed onto the circuit board 20, the positioning protruding block 140 may be aligned with the positioning hole 24 of the circuit board 20 and the two fixing members 120 respectively pass through the two assembling holes 22, and since the flexible segment portions 124 are flexible, in the process of when the fixing member 120 passes through the assembling hole 22, the two flexible segment portions 124 of each fixing member 120 may slightly be approached to each other and pass through the assembling hole 22. When the flexible segment portions 124 pass through the assembling hole 22 and extend toward the other surface of the circuit board 20, the flexible segment portions 124 may move toward directions away from one another in order to return to the original status. In the embodiment, the maximum outer diameter of the flexible segment portions 124 of the fixing member 120 is W mm, the diameter of the assembling hole 22 is D mm, wherein D mm<W mm≤D+0.2 mm, and in another embodiment, the maximum outer diameter of the flexible segment portions 124 may comply with: D mm<W mm≤D+0.1 mm. In other words, under a condition that the flexible segment portions 124 are not compressed, the maximum outer diameter may be larger than the diameter of the assembling hole 22. Thus, the flexible segment portions 124 may stay at the other surface of the circuit board 20, such that the fixing bracket for signal connector 100 is fixed to the circuit board 20. In the embodiment, the diameter D mm of the assembling hole 22 is between 33 mm and 3.7 mm. In another embodiment, D mm is 3.5 mm, but the disclosure is not limited by the abovementioned embodiments.

Moreover, when the flexible segment portions 124 may stay at the other surface of the circuit board 20, the flexible segment portions 124 may contact the circuit board 20 as shown in FIG. 3E, in order to provide a friction force between the fixing member 120 and the circuit board 20, and so that the fixing member 120 may not easily fluctuate with respect to the circuit board 20. As shown in FIG. 3C, in the embodiment, a connecting line of the two flexible segment portions 124 of one of the two fixing members 120 intersects a connecting line of the two flexible segment portions 124 of the other of the two fixing members 120. For instance, if the connecting line of the two flexible segment portions 124 of one of the two fixing members 120 is along the first axis A1 and the connecting line of the two flexible segment portions 124 of the other of the two fixing members 120 is along the second axis A2, then via such configuration of the fixing bracket for signal connector 100 of the embodiment, the fixing member 120 and the circuit board 20 may not easily have relative movements in different directions, and thus the fixing bracket for signal connector 100 may be firmly fixed onto the circuit board 20.

Figure 3F:
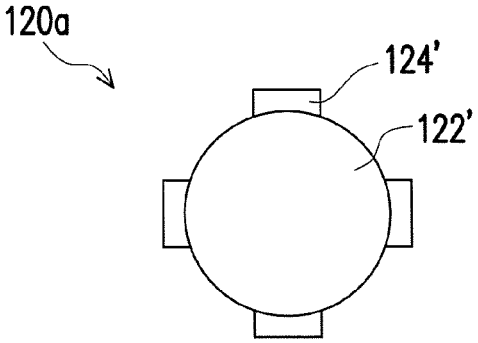
FIG. 3F is a schematic top view illustrating another type of fixing member.

The abovementioned only illustrates one of the conditions of the fixing member 120, in other embodiments, the fixing bracket for signal connector 100 may merely have one fixing member 120*a*. FIG. 3F is a schematic top view illustrating another type of fixing member. Referring to FIG. 3F, the fixing member 120*a* may have four flexible segment portions 124' which are disposed around the end portion 122' in a manner that any two of them are opposite, wherein the connecting line of the two opposite flexible segment portions 124' intersects the connecting line of the other two opposite flexible segment portions 124', such that the fixing member 120*a* and the circuit board 20 may not easily have relative movements in different directions.

Figure 3G:
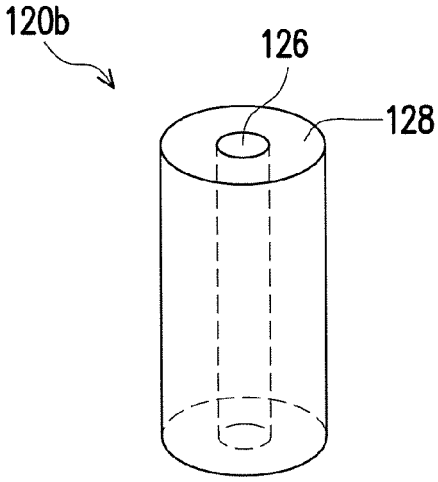
FIG. 3G is a schematic view illustrating another type of fixing member.

In addition, the method for the fixing bracket for signal connector 10 being fixed to the circuit board 20 is not limited by the abovementioned. FIG. 3G is a schematic view illustrating another type of fixing member. Referring to FIG. 3G, the fixing member 120*b* includes a protruding column 126, wherein the periphery of the protruding column 126 is enclosed by a buffering layer 128 having flexibility, and the buffering layer 128 is a high density foam, or the like, for example, but the material of the buffering layer 128 is not limited thereto. When the fixing member 120*b* is assembled to the circuit board 20, the buffering layer 128 is squeezed first, then the fixing member 120*b* stretches into the assembling hole 22 of the circuit board 20, and then when the buffering layer 128 recovers, it may squeeze the wall surface of the assembling hole 22, such that the fixing member 120*b* is fixed to the circuit board 20. The designer may adjust the material and thickness of the buffering layer 128 according to abovementioned concept, in order to achieve the effect of the fixing member 120*b* being firmly fixed to the circuit board 20.

The fixing bracket for signal connector 100 of the embodiment may be assembled to the circuit board 20 in only one step through the fixing member 120, 120*a*, 120*b*, and the signal connector 10 may be restricted by the two engaging sets 130 in only one step. In the manufacturing process, the signal connector 10 may be assembled to the fixing bracket for signal connector 100 in advance and after that together fixed to the circuit board 20, or the fixing bracket for signal connector 100 may be fixed to the circuit board 20 in advance and after that the signal connector 10 may be assembled to the fixing bracket for signal connector 100, and in any of mentioned methods, it is very rapid and simple in assembling, and no metal element is required, and thus the assembling steps and manufacturing cost may be effectively reduced.

Figure 4:
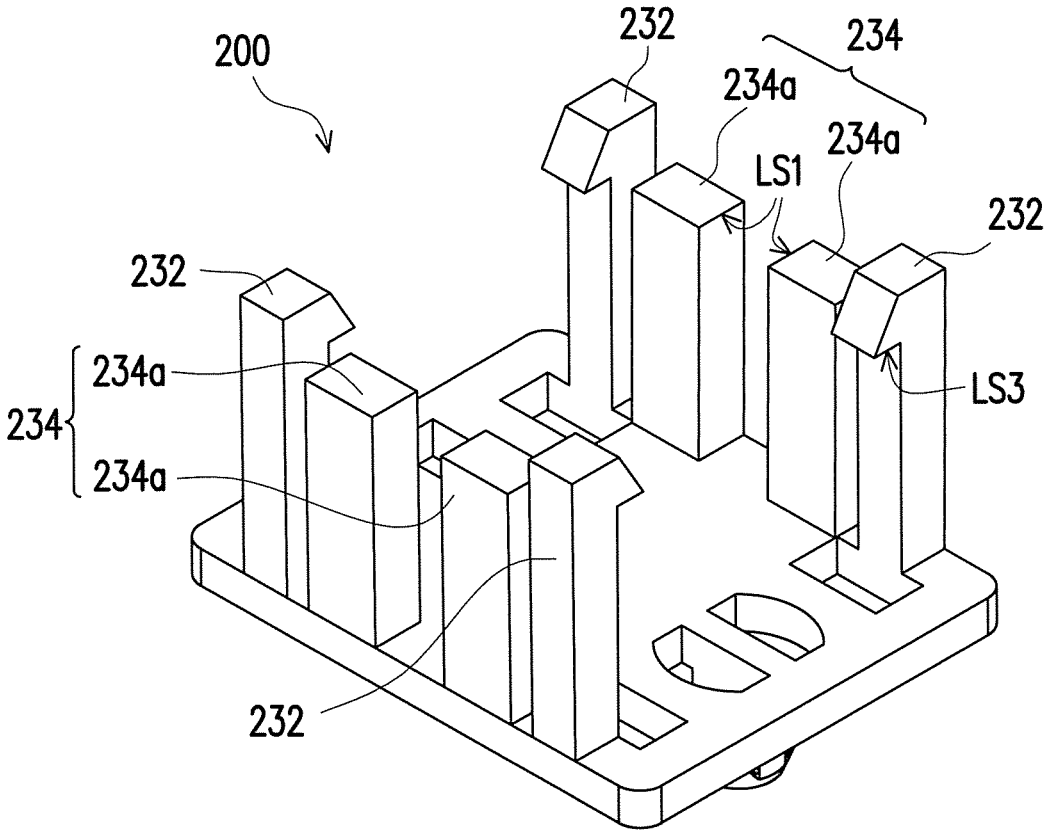
FIG. 4 is a schematic view illustrating a fixing bracket for signal connector according to another exemplary embodiment of the disclosure.

FIG. 4 is a schematic view illustrating a fixing bracket for signal connector according to another exemplary embodiment of the disclosure. Referring to FIG. 4, the main difference between a fixing bracket for signal connector 200 of FIG. 4 and the fixing bracket for signal connector 100 of FIG. 3A is that; in FIG. 3A, the engaging slot 134 is an upside-down U-shaped protruding column, and in the embodiment, an engaging slot 234 is composed of two separated rectangular shape protruding columns 234*a*.

Since different signal connectors 10 may have protruding portions 14 with different length specifications, in order to avoid a condition that the engaging slot 234 has a limitation in depth and the protruding portions 14 having longer protruding lengths may not enter the engaging slot 234, in the embodiment, the engaging slot 234 of the fixing bracket for signal connector 200 is specifically designed to be two separated rectangular protruding columns 234*a*, wherein when the signal connector 10 is disposed into the fixing bracket for signal connector 200 of the embodiment, the protruding portions 14 of the signal connector 10 may be located between the two separated rectangular columns 234*a*. In each engaging set 230, the two opposite surfaces of the two rectangular columns 234*a* are two first restricting surfaces LS1, and the fixing bracket for signal connector 200 of the embodiment may similarly achieve the effect that through the two first restricting surfaces LS1, the signal connector 10 is restricted to have movement along the first axis A1. In addition, the fixing bracket for signal connector 200 of the embodiment may be used for fixing the signal connectors 10 in which the protruding portions 14 thereof have different length specifications.

Figure 5:
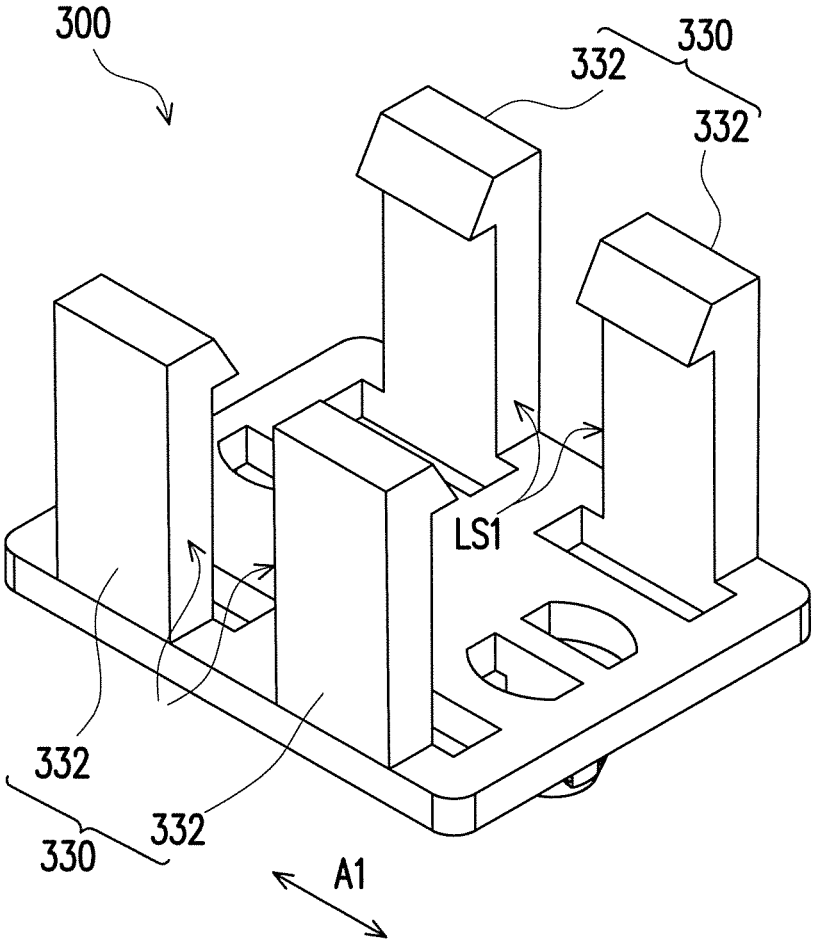
FIG. 5 is a schematic view illustrating a fixing bracket for signal connector according to another exemplary embodiment of the disclosure.

FIG. 5 is a schematic view illustrating a fixing bracket for signal connector according to another exemplary embodiment of the disclosure. Referring to FIG. 5, the main difference between a fixing bracket for signal connector 300 of FIG. 5 and the fixing bracket for signal connector 100 of FIG. 3A is that; in the embodiment, each engaging set 330 merely includes two hook-shaped flexible arms 332, wherein in each engaging set 330, the width between the two hook-shaped flexible arms 332 is substantially equal to the distance between the two first surfaces S1 of the protruding portions 14 of the signal connector 10. In other words, compared with the embodiment of FIG. 3A, the fixing bracket for signal connector 300 of the embodiment omits the engaging slot, and directly uses the two opposite surfaces between the two hook-shaped flexible arms 332 of each engaging set 330 as the two first restricting surfaces LS1, in order to contact the two first surfaces S1 of the protruding portions 14 of the signal connector 10, and restricts the signal connector 10 from moving toward the first axis A1.

In the embodiment, the width of the hook-shaped flexible arms 332 is wider, and in other embodiments, the width of the hook-shaped flexible arms 332 may be approximate to the width of the hook-shaped flexible arms 132 of FIG. 3A, as long as the width between the two hook-shaped flexible arms 332 is substantially equal to the distance between the two first surfaces S1 of the protruding portions 14 of the signal connector 10, so that when the signal connector 10 is located between the two engaging sets 330, it may contact the two first surfaces S1 of the protruding portions 14 of the signal connector 10.

Figure 6:
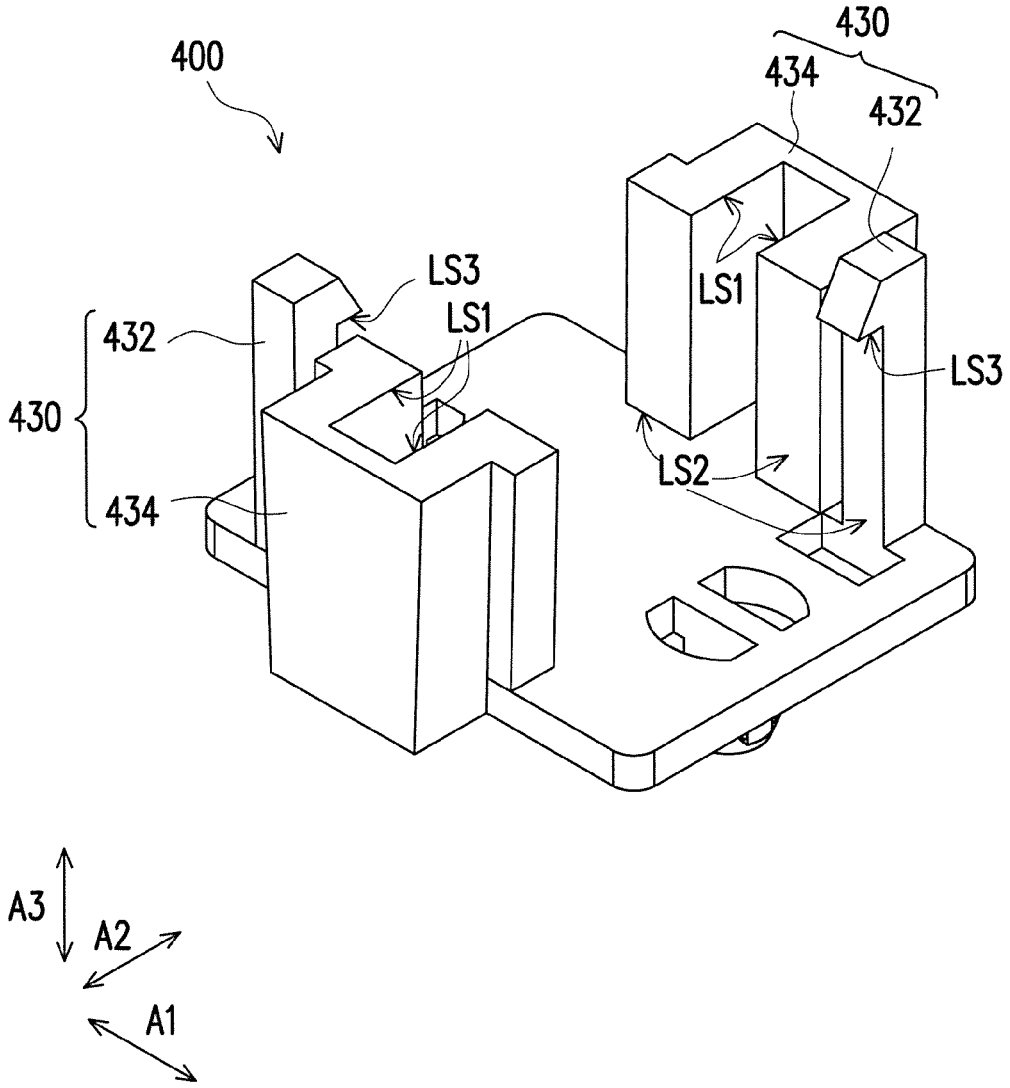
FIG. 6 is a schematic view illustrating a fixing bracket for signal connector according to another exemplary embodiment of the disclosure.

FIG. 6 is a schematic view illustrating a fixing bracket for signal connector according to another exemplary embodiment of the disclosure. Referring to FIG. 6, the main difference between a fixing bracket for signal connector 400 of FIG. 6 and the fixing bracket for signal connector 100 of FIG. 3A is that; in the embodiment, each engaging set 430 merely includes a hook-shaped flexible arm 432 and an engaging slot 434 located at a side of the hook-shaped flexible arm 432. The tow engaging slots 434 of the two engaging sets 430 are opposite, but the two hook-shaped flexible arms 432 are staggered. Namely, projections of the two second restricting surfaces LS2 of the two hook-shaped flexible arms 432 projecting onto a surface on which any one of the two second restricting surfaces LS2 exists are not overlapped to each other.

In the embodiment, each engaging slot 434 and the engaging slot 134 of FIG. 3A are the same, both have two first restricting surfaces LS1 for contacting the two first surfaces S1 of the two protruding portions 14 respectively, and the signal connector 10 moving toward the first axis A1 is restricted. In addition, the four second restricting surfaces LS2 the two engaging slots 434 and the two second restricting surfaces LS2 of the two hook-shaped flexible arms 432 contact the second surfaces S2 of the body 12 of the signal connector 10 respectively, in order that the signal connector 10 moving toward the second axis A2 is restricted. The two hook-shaped flexible arms 432 may respectively have the third restricting surfaces LS3, so that the third restricting surfaces LS3, together with the top surface 112 of the base 110, restrict the third surfaces S3 of the body 12 of the signal connector 10, in order that the signal connector 10 moving toward the third axis A3 is restricted.

In the fixing bracket for signal connector 400 of the embodiment, via the two hook-shaped flexible arms 432 being staggered, after the signal connector 10 is assembled, it may provide a better restricting function to the third surfaces LS3 of the signal connector 10. Therefore, the fixing bracket for signal connector 400 of the embodiment may still firmly fix the signal connector 10 under a condition of having a less number of hook-shaped flexible arms 432.

Certainly, in other embodiments, each engaging set 430 may also merely include a hook-shaped flexible arm 432 and an engaging slot 434, and the two hook-shaped flexible arms 432 and the two engaging slots 434 of the two engaging sets 430 may be disposed oppositely, and the configuration of the hook-shaped flexible arms 430 and the engaging slots 434 is not limited thereto.

Figure 7:
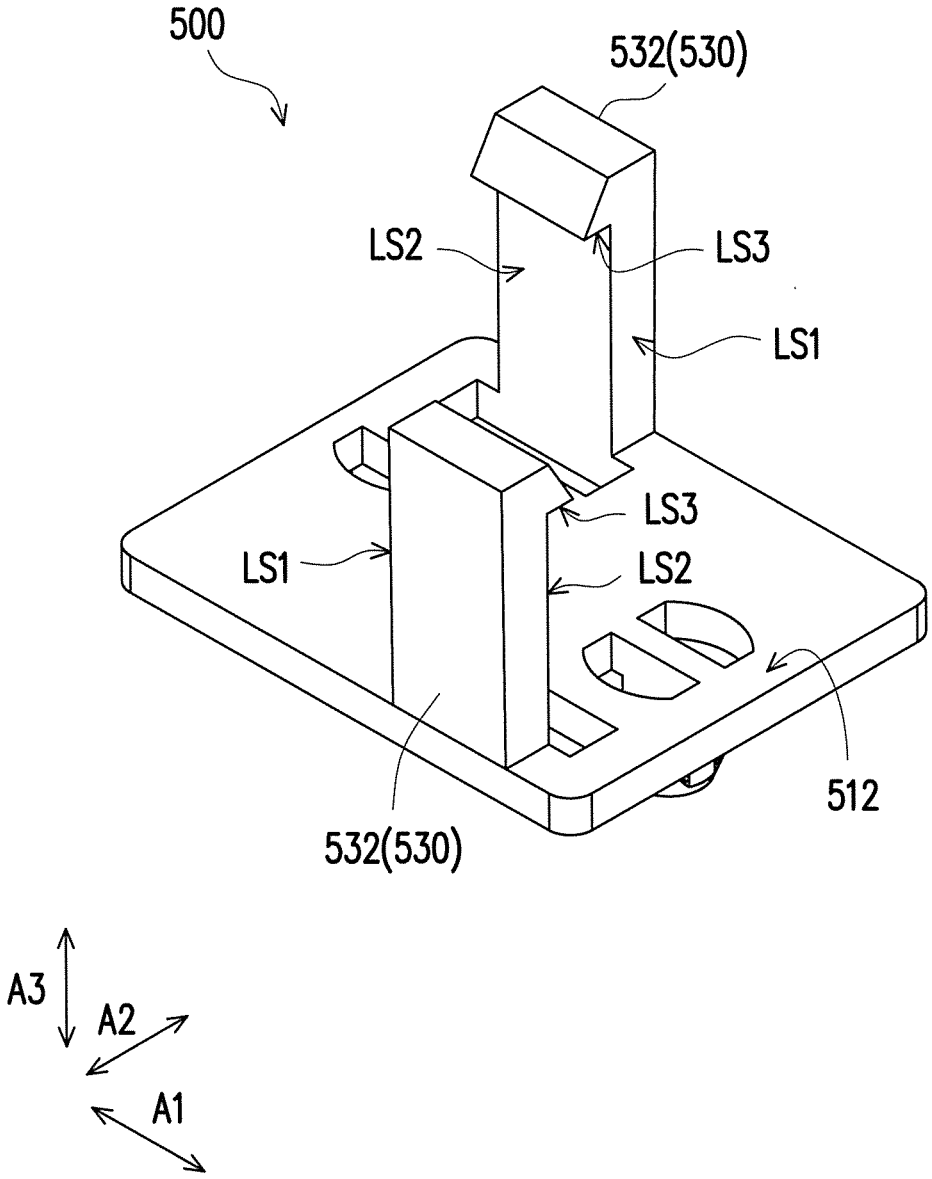
FIG. 7 is a schematic view illustrating a fixing bracket for signal connector according to another exemplary embodiment of the disclosure.

FIG. 7 is a schematic view illustrating a fixing bracket for signal connector according to another exemplary embodiment of the disclosure. Referring to FIG. 7, the main difference between a fixing bracket for signal connector 500 of FIG. 7 and the fixing bracket for signal connector 400 of FIG. 6 is that; in the embodiment, each engaging set 530 is a hook-shaped flexible arm 532, and the two hook-shaped flexible arms 532 are staggered. The projections of the two second restricting surfaces LS2 projecting onto a surface on which any one of the two second restricting surfaces LS2 exists are not overlapped to each other. In other words, compared to the embodiment of FIG. 6, the fixing bracket for signal connector 500 of the embodiment further omits the design of engaging slots, and achieves the effect of fixing the signal connector 10 merely through the two staggered hook-shaped flexible arms 532.

In detailed, each hook-shaped flexible arm 532 has a first restricting surface LS1, a second restricting surface LS2 and a third restricting surface LS3. The perpendicular distance between the two surfaces on which the two first restricting surfaces LS1 exist is substantially equal to the distance between the two first surfaces S1 of the protruding portions 14 of the signal connector 10. Thus, when the signal connector 10 is located between the two engaging sets 530, the first restricting surfaces LS1 of each hook-shaped flexible arm 532 respectively contact one of the first surface S1 of one of the protruding portions 14, and the two first surfaces S1 which contact the two first restricting surfaces LS1 are not coplanar, so as to restrict the signal connector 10 from moving along the first axis A1. The two second restricting surfaces LS2 of the two hook-shaped flexible arms 532 contact the two second surfaces S2 of the signal connector 10 respectively, in order that the signal connector 10 moving toward the second axis A2 is restricted, and the two third restricting surfaces LS3 and the top surface 512 contact the two third surfaces S3, in order that the signal connector 10 moving toward the third axis A3 is restricted. Therefore, the fixing bracket for signal connector 500 of the embodiment may achieve the effect of fixing the signal connector 10 by using less components.

In light of the foregoing, in the fixing bracket for signal connector of the disclosure, two engaging sets protruding from the top surface are used for fixing the signal connector, and the first, second and third restricting surfaces of the two engaging sets may contact the first, second and third surfaces of the signal connector, so that the signal connector may be restricted in different directions, and firmly fixed in the fixing bracket for signal connector. Since the hook-shaped flexible arms of the engaging sets are flexible, the signal connector may directly be compressed between the two engaging sets during the assembling process, or the user may directly separate the hook-shaped flexible arms, in order that the signal connector may enter the space between the two engaging sets, the signal connector may be fixed to the fixing bracket for signal connector in only one step. In addition, in the fixing bracket for signal connector of the disclosure, through the fixing member protruding from the bottom surface, wherein the flexible segment portions of the fixing member may be flexibly deformed to pass through the assembling hole of the circuit board first and may recover after passing through, and since the maximum outer diameter of the flexible segment portions when the flexible segment portions are not compressed is larger than the diameter of the assembling hole, the flexible segment portions may stay on the other surface of the circuit board, such that the fixing bracket is rapidly assembled to the circuit board in one only step. Moreover, through the flexible segment portions contacting the circuit board so as to provide the friction force between the fixing bracket and the circuit board, the signal connector is firmly fixed on the circuit board. Therefore, the fixing bracket for signal connector of the disclosure may be rapidly and simply fixed to the circuit board during the assembling process, and no metal element is required. Thus, manufacturing cost may be effectively reduced.

The fixing bracket for signal connector of the disclosure may be easily fixed to the circuit board, and is also provided for the signal connector being fixed thereto. The assembling process is quite rapid and simple, and any metal element is not required. Thus, manufacturing cost may be effectively reduced.

Although the disclosure has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. A fixing bracket for signal connector, adapted for fixing a signal connector to a circuit board, wherein the circuit board comprises an assembling hole, the signal connector comprises a body and two protruding portions symmetrically protruding from the body, each of the protruding portions has two opposite first surfaces, the body has two opposite second surfaces and two opposite third surfaces, each of the first surfaces, each of the second surfaces and each of the third surfaces are perpendicular to one another, the fixing bracket for signal connector comprising:

a base, comprising a top surface and a bottom surface opposite to each other;

at least one fixing member, protruding from the bottom surface of the base, wherein each of the at least one fixing member is adapted to pass through the assembling hole from a surface of the circuit board and interfere with another surface of the circuit board; and two engaging sets, protruding from the top surface of the base, each of the two engaging sets comprising at least one first restricting surface perpendicular to the top surface, at least one second restricting surface perpendicular to the top surface, and a third restricting surface parallel to the top surface, and the at least one first restricting surface adjacent to the at least one second restricting surface, wherein the two at least one first restricting surfaces of the two engaging sets are adapted to respectively at least contact one of the two first surfaces of each of the two protruding portions of the signal connector, the two first surfaces which contact the two at least one first restricting surfaces of the two engaging sets are not coplanar, the two at least one second restricting surfaces of the two engaging sets are adapted to respectively contact the two second surfaces of the signal connector, and the two third restricting surfaces of the two engaging sets and the top surface are adapted to respectively contact the two third surfaces of the signal connector, so as to fix the signal connector.

2. The fixing bracket for signal connector as claimed in claim 1, wherein each of the two engaging sets is a hook-shaped flexible arm, and the two engaging sets are staggered, such that projections of the two at least one second restricting surfaces projecting onto a surface on which any one of the two at least one second restricting surfaces exists are not overlapped to each other.

3. The fixing bracket for signal connector as claimed in claim 1, wherein each of the two engaging sets comprises two hook-shaped flexible arms, and the two engaging sets are disposed oppositely.

4. The fixing bracket for signal connector as claimed in claim 1, wherein each of the two engaging sets comprises a hook-shaped flexible arm and an engaging slot located at a side of the hook-shaped flexible arm, the two hook-shaped flexible arms are staggered and the two engaging slots are disposed opposite to each other, each of the engaging slots extends away from the top surface, and the at least one first restricting surface is one of innerwall surfaces of the engaging slot.

5. The fixing bracket for signal connector as claimed in claim 1, wherein each of the two engaging sets comprises two hook-shaped flexible arms and an engaging slot, the engaging slot is located between the two hook-shaped flexible arms and extends away from the top surface, the at least one first restricting surface is one of innerwall surfaces of the engaging slot, and the two engaging sets are disposed oppositely.

6. The fixing bracket for signal connector as claimed in claim 1, further comprising a positioning protruding block protruding from the bottom surface of the base, and the circuit board further comprising a positioning hole corresponding to the positioning protruding block.

7. The fixing bracket for signal connector as claimed in claim 1, wherein each of the at least one fixing member comprises an end portion which is away from the bottom surface and at least two flexible segment portions, the at least two flexible segment portions are averagely disposed around the end portion and extend toward the bottom surface, a maximum outer diameter of the at least two flexible segment portions is W mm, a diameter of the assembling hole is D mm, wherein $D\ mm < W\ mm \leq D+0.2\ mm$.

8. The fixing bracket for signal connector as claimed in claim 7, wherein a number of the at least one fixing member is two, each of the at least one fixing member comprises two flexible segment portions, a connecting line of the two flexible segment portions of one of the two fixing members intersects a connecting line of the two flexible segment portions of the other of the two fixing members.

9. The fixing bracket for signal connector as claimed in claim 1, wherein a diameter of the assembling hole is D mm, and $3.3\ mm < D < 3.7\ mm$.

10. The fixing bracket for signal connector as claimed in claim 1, wherein the signal connector is an optical fiber signal connector.

* * * * *